United States Patent [19]

Ramey

[11] Patent Number: 4,493,205

[45] Date of Patent: Jan. 15, 1985

[54] PNEUMATICALLY DRIVEN RIVET INSERT TOOL

[75] Inventor: Carl Ramey, Yellville, Ark.

[73] Assignee: Micro Plastics Inc., Flippin, Ark.

[21] Appl. No.: 427,173

[22] Filed: Sep. 29, 1982

[51] Int. Cl.[3] ..... B21D 31/00

[52] U.S. Cl. ..... 72/391; 72/453.19; 29/243.53

[58] Field of Search ..... 72/391, 453.17, 453.19; 227/130, 55; 29/243.53, 522 A, 526 A; 81/463

[56] References Cited

U.S. PATENT DOCUMENTS

| | | | |
|---|---|---|---|
| 3,032,771 | 5/1962 | Bisbing | 72/391 |
| 3,042,004 | 7/1962 | Fischer et al. | 72/453.17 |
| 3,442,112 | 5/1969 | Abromavage et al. | 72/391 |
| 3,613,431 | 10/1971 | Meyer | 72/391 |
| 3,908,257 | 9/1975 | Briles | 72/391 |
| 3,933,025 | 1/1976 | Briles | 72/391 |

*Primary Examiner*—Daniel C. Crane
*Assistant Examiner*—David B. Jones
*Attorney, Agent, or Firm*—Stephen D. Carver

[57] ABSTRACT

Pneumatically powered expansion rivet applicator tools. Each of the tools described herein comprise a rigid body adapted to be manually grasped by the user. First and second pneumatic cavities are housed within the body. Pneumatic coupling means associated with the body supply high pressure air to the first cavity. A fitting associated with the body receives the cylindrical shank of an expansion rivet to be installed by the tool. Fluid flow passageway means interconnect the first and second cavities, and an internal valve permits passage of high pressure air through the passageway between the first and second cavities. Piston means are slidably disposed within the second cavity, and, in response to pressurization of the second cavity, virtually instantaneously contacts associated firing pin means to forceably ram the expansion rivet shank, thereby installing the rivet. In the best mode a tubular handle which is coaxial with the body is moved axially with respect thereto for selectively activating the air valve means to subsequently initiate piston and thus firing pin actuation.

3 Claims, 12 Drawing Figures

FIG. 1
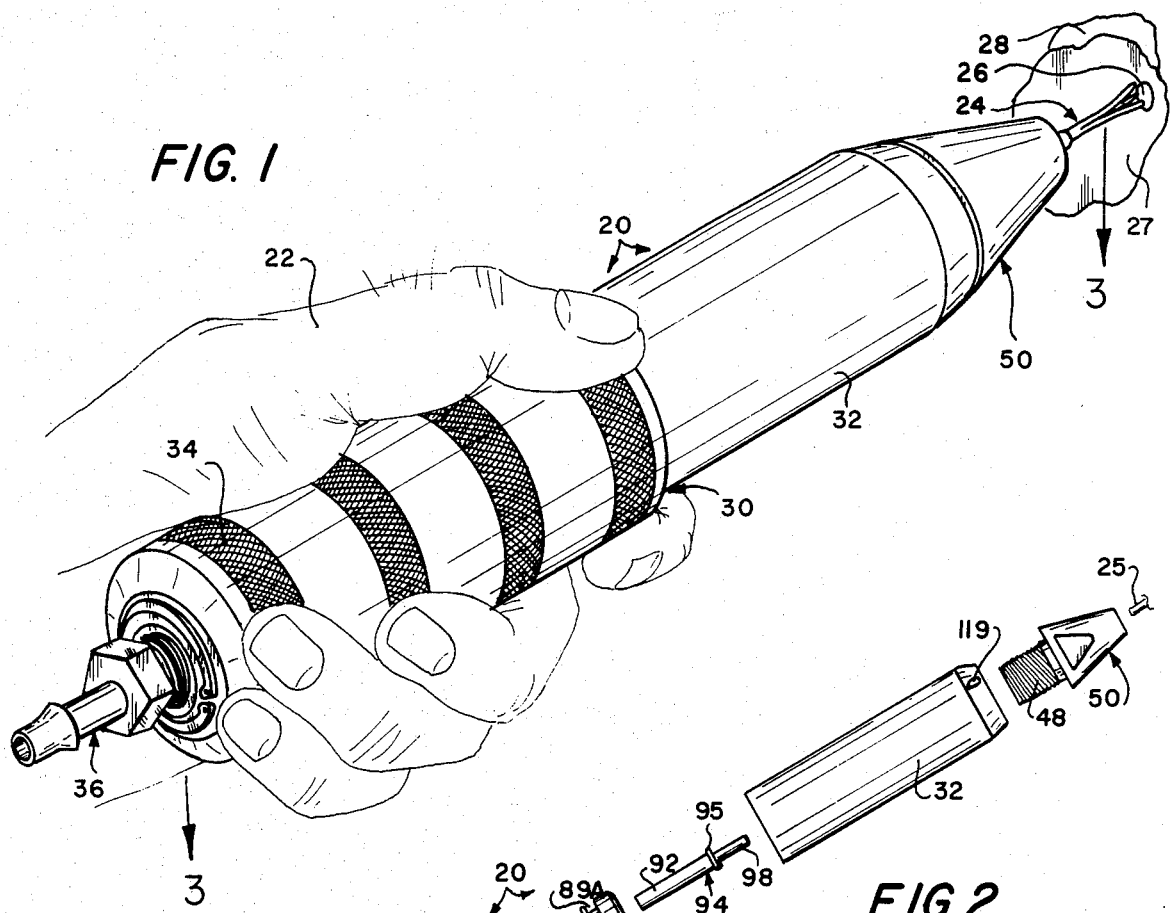
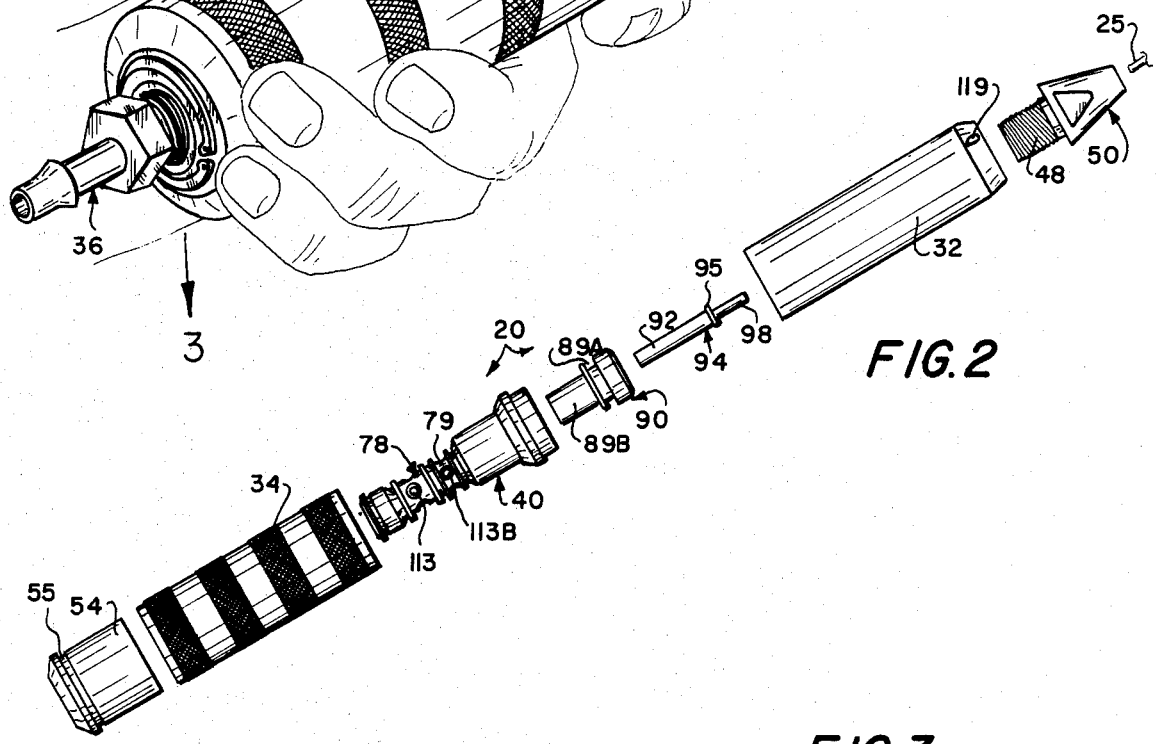
FIG. 2
FIG. 3
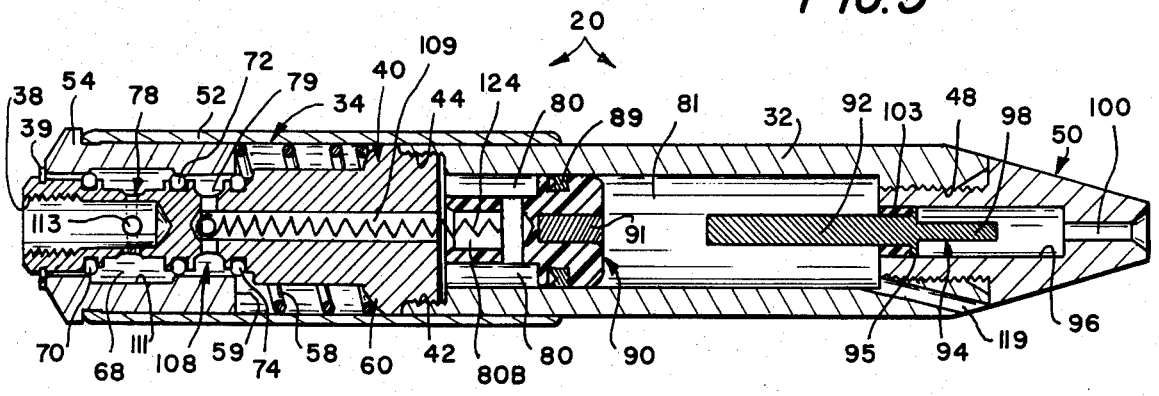

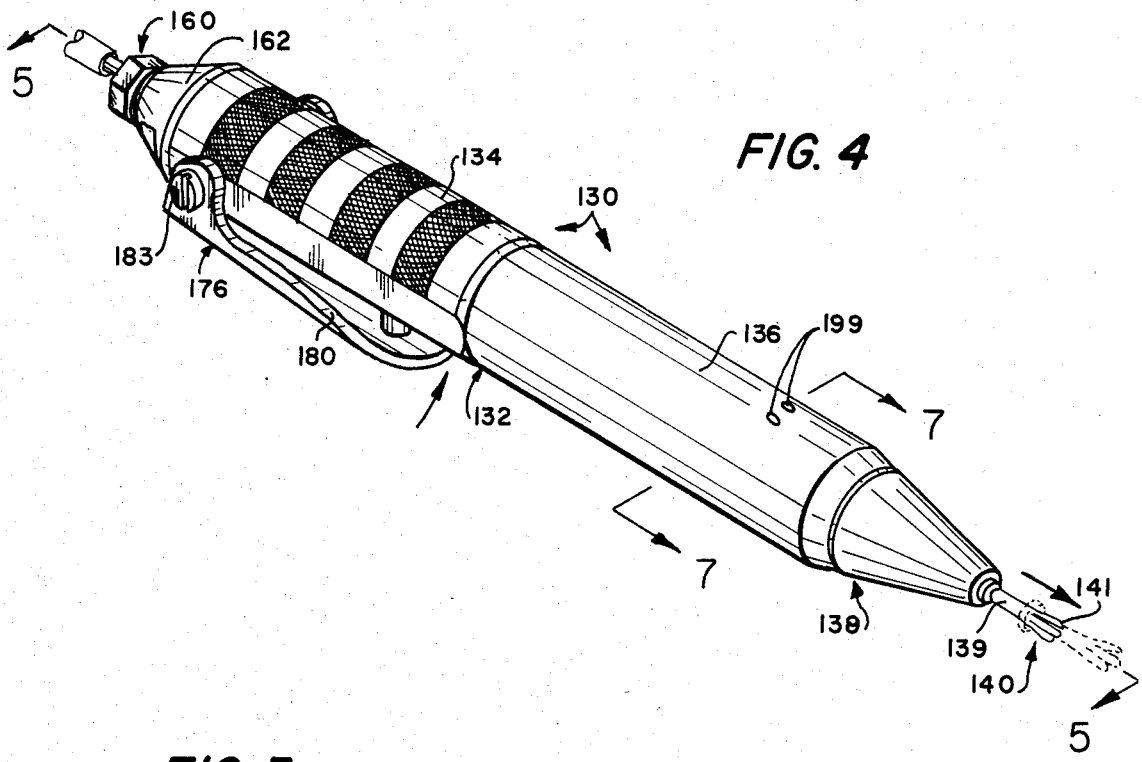
FIG. 4
FIG. 5
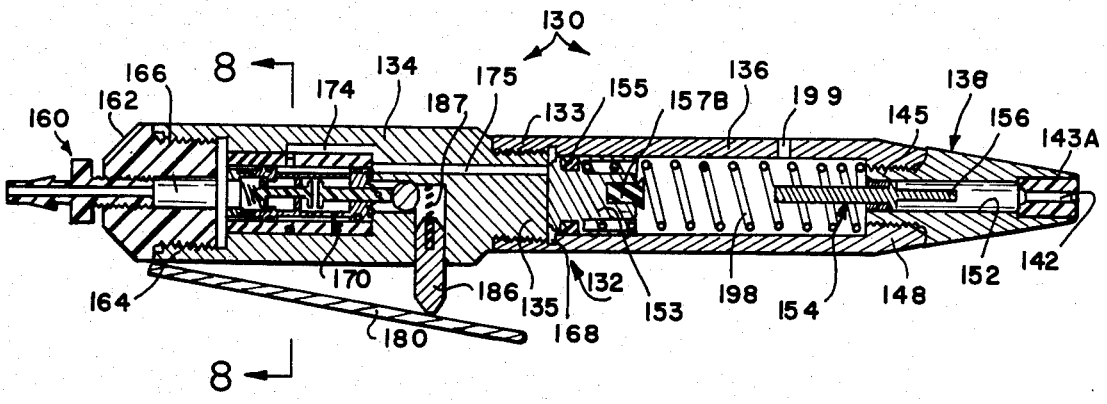
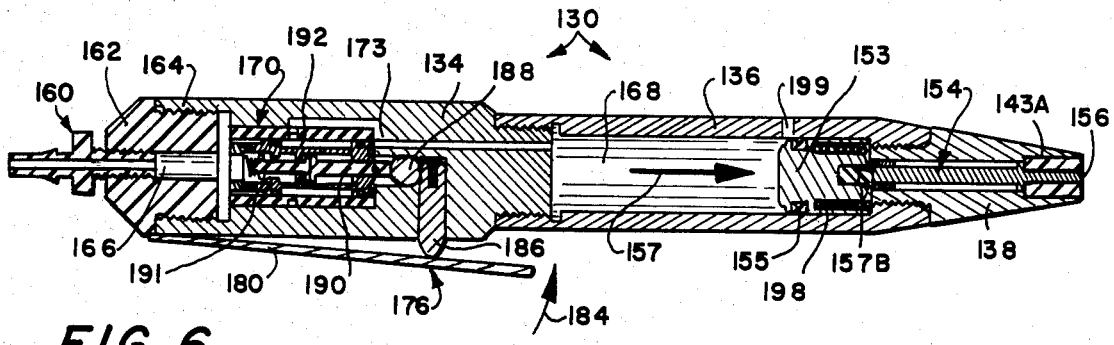
FIG. 6

PNEUMATICALLY DRIVEN RIVET INSERT TOOL

BACKGROUND OF THE INVENTION

The present invention relates generally to the installation of conventional plastic expansion rivets. More particularly, the present invention is concerned with a plurality of pneumatically driven expansion rivet applicator tools suitable for quickly and easily installing plastic expansion rivets.

In the prior art plastic expansion rivets are well known. Preferably such rivets may be molded through conventional plastic injection molding techniques in a single, one piece unit. A typical expansion rivet includes an intermediate flange portion separating an integral, generally cylindrical stem from an adjacent tubular expansible segment. Such rivets may be employed to fasten a pair of workpieces together by first inserting the expansible portion through aligned, adjacent orifices. Afterwards, a mallet or tool such as a hammer or the like may be employed to ram the expansion fitting shank through the flange, coaxially interiorly of the expansion portion, thereby expanding same. Such expansion prevents subsequent withdrawal of the fitting, which secures the workpieces together.

In the aircraft industry conventional aircraft assembly demands the temporary securement of sheet metal parts together. At this time a metallic "Clico" or "Wedgelock" tool is employed to temporarily, yieldably secure aligned metallic parts together. This tool includes a rigid, metallic sleeve including an axially displaceable portion associated therewith. Forwardly projecting from the sleeve are a plurality of fork-like tongs, which are expanded when a flat tongue is projected axially forward therewithin. While such a tool will yieldably maintain two or more workpieces together (providing their apertures are aligned) the cost of such a tool is a major detriment, since a separate tool is required for each orifice group to be aligned.

While metallic rivets could be used to maintain proper operative alignment of sheet metal parts, subsequent removal of such rivets is obviously difficult and time consuming. On the other hand, if plastic expansion rivets could be employed to temporarily maintain aligned sheet metal workpieces together, their subseqent removal through drilling or the like would be quick, easy and inexpensive. Moreover, during the critical removal phase, damage to the high tolerance metallic sheet metal parts would be minimized if not altogether avoided.

Hence it is desirable to provide some form of pneumatic applicator tool for quickly and easily inserting plastic expansion rivets during aircraft assembly. Of course, such a tool would find wide application in other assembly arts where plastic expansion rivets may be installed either temporarily or permanently.

SUMMARY OF THE INVENTION

The present invention comprises a hand held, pneumatic, expansion rivet tool adapted to quickly install expansion rivets to fasten workpieces together. Three general embodiments of the present invention are contemplated.

In each embodiment a rigid body adapted to be manually grasped by a workman includes first and second internal pneumatic cavities. Pneumatic coupling means are secured to the body to provide a quick connection to a conventional air hose. A fitting is provided for receiving the shank of an expansion rivet to be installed by the tool. Preferably the fitting is removably attached to the body, such that different fittings of varying sizes may be employed to accomodate the use of the tool with expansion fittings of varying dimensions.

A fluid flow passageway interconnects the first and second cavities within the body. Internal valve structure is provided to selectively unblock this passageway, whereby to pressurize the second cavity. Piston means slidably disposed within the second cavity will virtually instantaneously be displaced in response to pressure, being axially deflected into ramming contact with a firing pin preferably associated with the fitting means. The firing pin is axially, slidibly forced into ramming contact with the shank of the expansion fitting to jam it through the fitting, expanding and installing the fitting. Of course, when the fitting is so installed, the shank of the fitting will be ejected from the tool, which must then be reloaded manually.

Trigger means are provided in association with the body to actuate the internal valve to fire the mechanism. In the preferred embodiment the tool body comprises a generally cylindrical rigid portion, and a coaxially fitted, axially sidable rear portion which functions as the trigger when axially moved relative to the main body portion. In an alternative embodiment, the body, also of generally tubular configuration, includes a trigger in the form of a lever which is pivotally coupled to the body rear Finally, in a third embodiment, the body is generally in the form of a pistol, and the hand grip portion of the body includes a finger operated trigger.

Thus a broad object of the present invention is to provide a pneumatic system for installing plastic expansion rivet.

Another object of the present invention is to provide a system for reliably and quickly installing plastic rivets which system will replace metallic tools otherwise employed in the aircraft industry.

Another broad object of the present invention is to provide an efficient system for temporarily securing metallic parts together during assembly of aircraft sheet metal components.

Yet another object of the present invention is to completely obviate the use of hammers, mallets or the like during installation of expansion rivets.

Yet another object of the present invention is to provide an expansion rivet applicator of the character described which may employ a variety of applicator heads of varying geometry to enable the installation of different sized rivets.

Another object of the present invention is to provide a system for quickly installing plastic expansion rivets to yieldably, temporarily align sheet metal parts together during manufacture.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views;

FIG. 1 is a fragmentary pictorial view of a preferred embodiment of the present rivet applicator tool, illustrating the deivce in actual use;

FIG. 2 is a reduced scale, exploded isometric view of the tool of FIG. 1;

FIG. 3 is a longitudinal sectional view taken generally along line 3—3 of FIG. 1;

FIG. 4 is a pictorial view of an alternative embodiment of the present invention, illustrating the trigger in a "fire" position;

FIG. 5 is a longitudinal sectional view taken generally along line 5—5 of FIG. 4;

FIG. 6 is a longitudinal sectional view similar to FIG. 5, but illustrating the trigger and other parts in a "fired" position;

Figure 7:
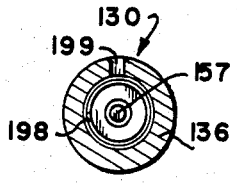
FIG. 7 is a sectional view taken generally along line 7—7 of FIG. 4.
Figure 8:
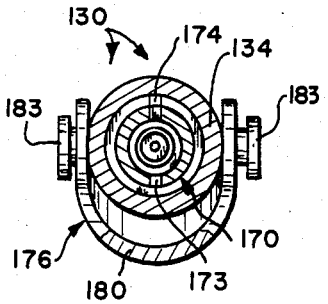
FIG. 8 is a sectional view taken generally along line 8—8 of FIG. 5.
Figure 9:
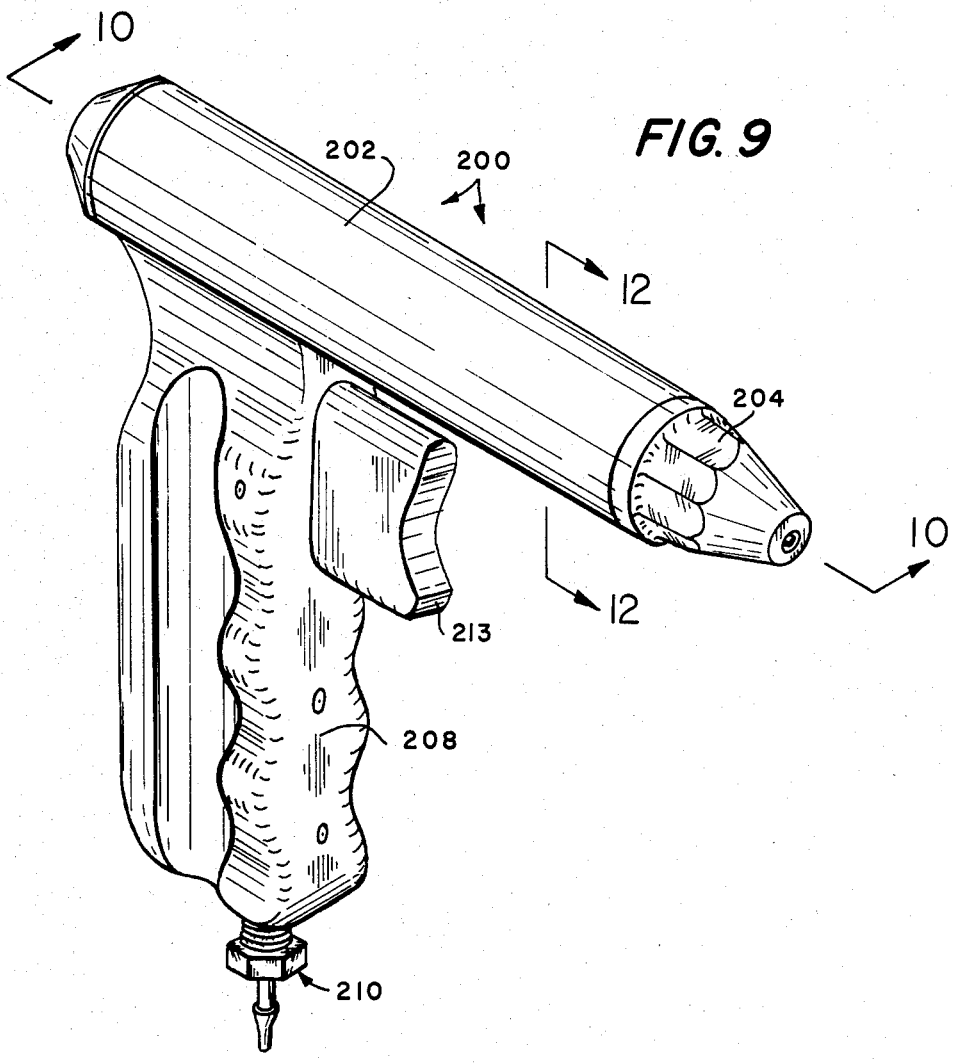
FIG. 9 is a pictorial view of a third, pistol-type embodiment of the present invention, illustrating the trigger in the "fire" position.

DETAILED DESCRIPTION OF THE DRAWINGS with initial reference now to FIGS. 1–3 of the drawings, the preferred embodiment of a pneumatic, expansion rivet applicator tool constructed in accordance with the teachings of the present invention has been generally designated by the reference numeral 20. Tool 20 is adapted to be held by hand 22 of the user to install a conventional expansion rivet 24 through suitable aligned orifices 26 whereby to fasten sheet metal parts 27, 28 together. Tool 20 is of generally cylindrical, rigid, elongated construction, and it includes a substantially cylindrical, main portion 32 and an associated, generally tubular portion 34 coaxially fitted to portion 32. High pressure air is nominally introduced to the system by connecting a conventional fitting 36 with a source of available air. Fitting 36 is threadably mated to threaded aperture 38 at the input of a pneumatic valve, generally designated by the reference numeral 40.

Valve 40 includes a threaded base portion 42 threadably mated to the threaded rear of body portion 32. The front of body portion 32 terminates in a similar tubular, internally theaded portion 48 which threadably receives a removable fitting, generally designated by the reference numeral 50. Body 34 includes a generally tubular rear segment 52 integral with rear sealing cap portion 54 which does not contact pneumatic fitting 38.

Rear body portion 34 is axially slidable towards a direction generally to the right as seen in FIG. 3. However, an internal coiled spring 58 disposed between shoulder 59 of cap 54 and a cooperating shoulder 60 defined in valve apparatus 40 normally biases the "handle" 34 outwardly with respect to body portion 32; snap-ring 39, secured within cap groove 55 prevents uncoupling of handle 34.

A first internal pneumatic cavity 68 is defined internally of the apparatus. Valve 40 includes a plurality of sealing O-rings 70, 72 and 74 seated within suitable grooves (FIG. 2) defined between reduced diameter valve portions 78 and 79. A second pneumatic cavity is disposed within body portion 32, immediately to the right of valve portion 42. This second cavity comprises portions 80 and 81 separated by piston 90. When cavity portion 80 is pressurized, resulting pressure experienced by internal, axially slidable piston 90 will force the piston towards the right (as viewed in FIG. 3) causing it to forcibly contact the rearwardly projecting shank 92 of the firing pin 94. A piston gasket 89 seals piston 90 within cavity segment 81. As best viewed in FIG. 3, firing pin 94 includes a slideable, central flange portion 95 axially, slidably, disposed within a cavity 96 within fitting 50. A forwardly projecting integral portion 98 of the firing pin is rammed into and through orifice 100 defined within fitting 50 to contact the shank 25 of the expansion rivet, which will have manually been positioned within orifice 100 prior to firing of tool 20. Firing pin 94 is freely disposed within the fitting means 50, being prevented from falling outwardly therefrom by reduced diameter shoulder 103 which contacts flange portion 95 to restrain the firing pin.

In operation cavity 68 will first be highly pressurized. An air-tight seal is provided by gasket 70, and 72. Air enters cavity 68 through valve orifice 113. When hand grip portion 34 is moved towards the right against yieldable pressure from spring 58, transverse air passageway 109 will be exposed when expanded internal diameter portion 111 of the cap 54 clears 0 ring 72. Air will enter valve orifice 113B prior to entering passageway 109 through volume 108, and air will thereafter enter cavity 80B within the sleeve portion 89B of piston 90. Immediate piston displacement will be caused, and cavity portion 80 will be pressurized. As piston 90 slides toward fitting 50, air will be forced out of cavity 81 via vent orifice 119. As piston 90 advances into forcible contact with firing pin 94, cavity region 81 will become pressurized; vent 119 will depressurize cavity 81 after firing.

Upon the subsequent return of piston 90 by return spring 124 which is preferably coaxially received through tubular passageway 109, air will be sucked into cavity region 81 through vent 119. Also, the handle portion 34 will be returned to the "fire" position (illustrated in FIG. 3) when released by operator, by spring 124.

With reference now to FIGS. 4–8, a second, generally tubular embodiment of the present invention has been generally designated by the reference numeral 130. The elongated, rigid body 132 is actually formed from a pair of axially aligned rigid plastic pieces 134 (which comprises a handle) and a main body portion 136. Body portion 136 threadably receives a fitting 138 which is adapted to receive the shank 139 of a conventional expansion rivet 140 to be installed by the tool 130. To this effect a front-mounted, shank receptive passageway 142 is defined in fitting 136. The threaded shank rear 145 is threadably coupled to the front threaded portion 148 of body portion 136. An internal passageway 152 (axially aligned with passageway 142) allows a firing pin, generally designated by the reference numeral 154, to be displaced axially. Firing pin portion 156 is adapted to forcibly contact expansion rivet shank 139 in response to extreme shock contributed by piston means, generally designated by the reference numeral 153. Reducer 143A separates passageways 142 and 152.

A conventional pneumatic fitting 160 is threadably coupled to end cap 162, which is in turn threadably secured to the rear 164 of tubular handle 134. A first pneumatic cavity 166 is defined within handle 134, and a second pneumatic cavity, generally designated by the reference numeral 168, is defined within portion 136 to the rear of piston 156. A valve assembly, generally designated by the reference numeral 170, selectively blocks air passageway 173, comprised of segments 174 and 175 interconnecting cavities 168 and 166. This valve assembly 170 is a Clippard-brand air valve of conventional construction. When activated by trigger assembly 176, high pressure air entering cavity 166 will be vented into cavity 168, forcing piston 153 rapidly to the right in the direction of arrow 157, whereby to force firing pin 154 into engagement with the shank 139 of the rivet 140, driving the stem 139 into rivet expansion portion 141, whereby to expand and install the rivet. Piston 153 is sealed within cavity 168 by O-ring 155, and it includes metallic reinforcement 157B for striking firing pin 154.

The trigger assembly 176 preferably includes a manual lever 180 pivotally coupled to body handle portion 134 with a pair of conventional screws 183. Lever 180 may be moved in the direction of arrow 184 to change from the "fire" position illustrated in FIG. 5 to the "fired" position illustrated in FIG. 6. To fire the rivet applicator 130 the user need merely squeeze trigger assembly 176. When lever 180 moves in the direction of arrow 184, a follower 186 is moved against predetermined pressure from spring 187, eventually contacting and moving a bearing 188 towards the left (as viewed in FIGS. 5 or 6). When this occurs, the actuating stem 190 of valve assembly 170 will be actuated to pressurize begion 192 by unblocking restriction 191. This results in pressurization of cavity 168 through passageway portions 174, 175 and 173. After the apparatus has been fired, lever 180 will be returned by spring 187 to its "fire" position, illustrated in FIG. 5, and piston 153 will be returned by spring 198. During the firing interval, vents 199 will depressurize second cavity 168, after passage of piston 156 to the extreme position. Then, as piston 156 is returned to the left by spring 198, air will be sucked through vent 199 into cavity 168.

Figure 11:
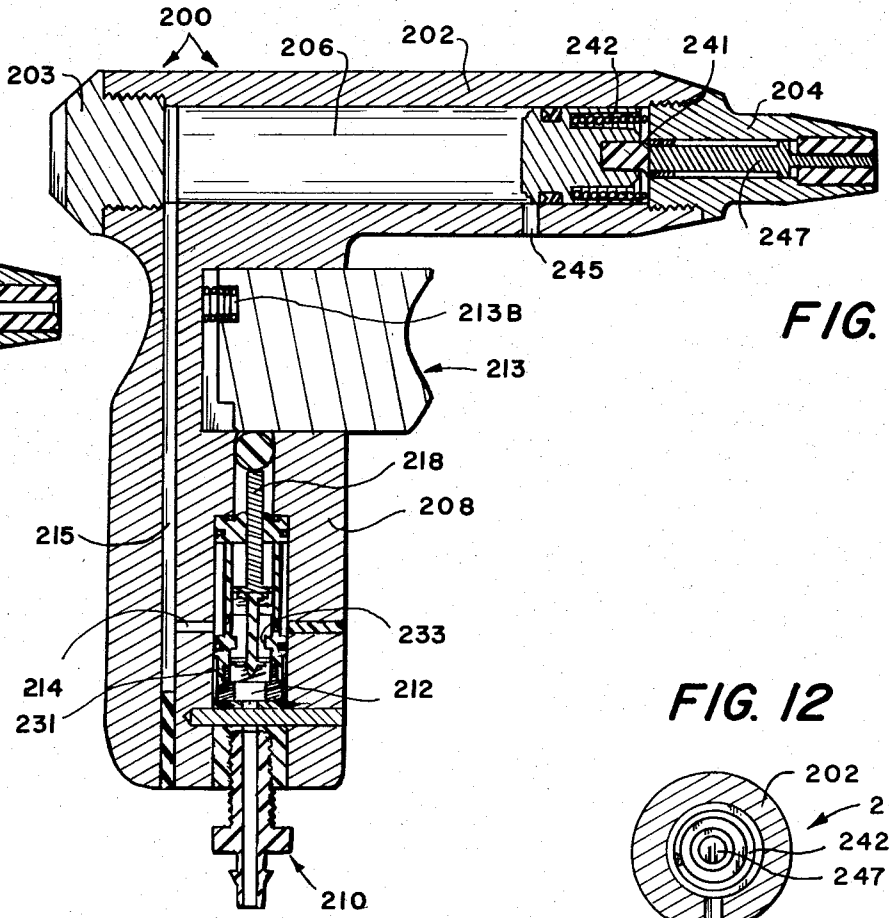
FIG. 11, is a view similar to FIG. 10, but illustrating the trigger and other internal parts disposed in a "fired" position; and, FIG. 12 is a sectional view taken generally along line 12—12 of FIG. 9.
Figure 12:
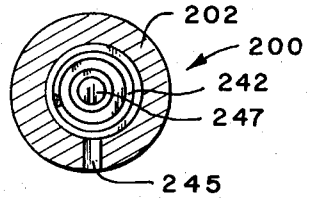
Figure 10:
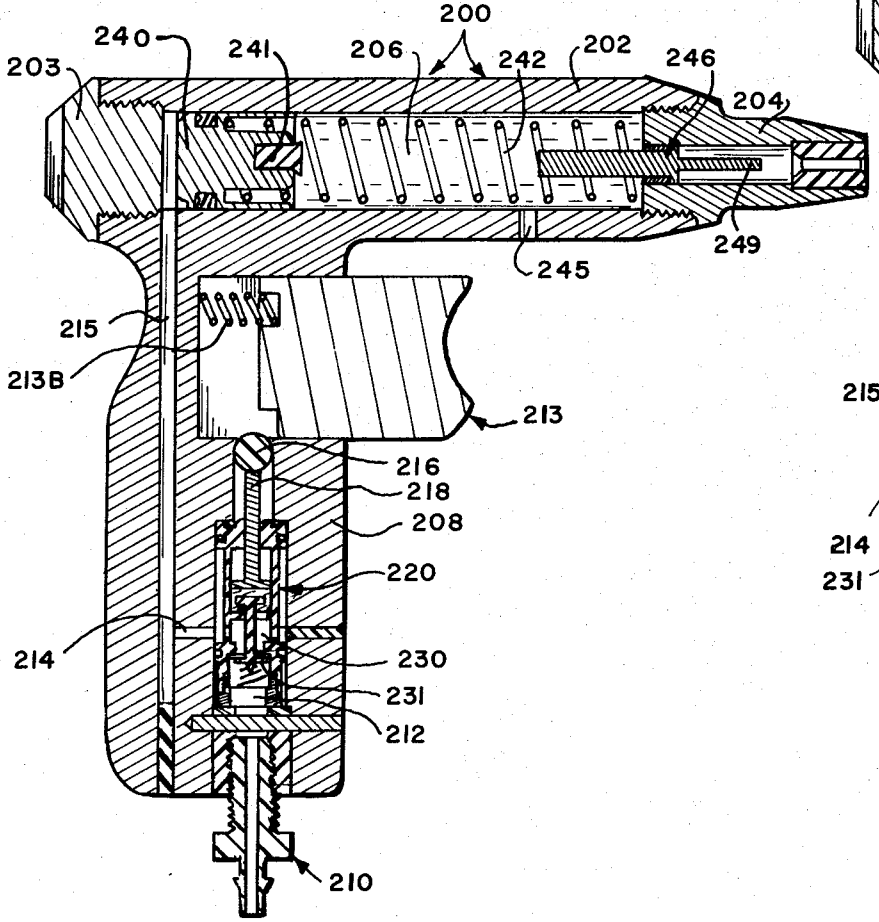
FIG. 10 is a sectional view taken generally along line 10—10 of FIG. 9.

With reference now to FIGS. 9–12, a pistol-type embodiment of the tool has been generally designated by the reference numeral 200. Tool 200 includes a generally horizontally oriented barrel portion 202 terminating in a removable fitting 204 similar to those previously discussed. The handle grip portion 208 of tool 200 is fitted with a conventional pneumatic fitting 210 adapted to be coupled to a source of high pressure air. Air is delivered through fitting 210 into a first pneumatic cavity generally designated by the reference numeral 212. (FIGS. 10, 11). A fluid flow passageway comprising passageways 214 and 215 interconnect cavities 212 and 206, providing the valve assembly 220 is actuated. Valve assembly 220 is similar to valve assembly 170 previously discussed, and, it is positioned within hand grip 208. It is actuated when trigger 213 is manually moved to the position illustrated in FIG. 11, against predetermined pressure from spring 213. When so actuated, trigger 213 will depress a bearing 216 which in turn depresses plunger 218 to actuate valve 20. At this time region 230 within valve assembly 220 will be pressurized as valve portion 213 will be moved out of abutment with valve shoulder 233 (FIG. 11).

A piston 240 is slidably displaceable within cavity 206 against predetermined pressure from spring 242 between the "fire" and "fired" positions respectively illustrated in FIGS. 10 and 11. When actuated, piston 240 will ram firing pin 246 to install and expel an expansion rivet. When moved to the extreme position, region 206 will be depressurized through vent orifices 245, which will prevent vacuum from being encountered as the piston is returned to its "fire" position (FIG. 10). Since barrel 202 is sealed at its rear with a threaded cap 203, piston withdrawl is impossible. Piston 240 preferably includes a front mounted reinforcement 241 for striking the firing pin 246.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A pneumatic expansion rivet applicator tool comprising:

rigid, elongated, generally cylindrical body means adapted to be manually grasped by a workman, said body means having first and second internal cavities;

pneumatic coupling means associated with said body means for supplying air pressure to said first cavity;

fitting means associated with said body means for receiving the shank of an expansion rivet to be installed by said tool;

fluid flow passageway means interconnecting said first and second cavities;

valve means disposed interiorly of said body means for normally blocking and selectively unblocking said fluid flow passageway means thereby permitting gas to flow from said first cavity to pressurize said second cavity;

firing pin means for slidably, forcibly, contacting said expansion rivet shank when activated to install said rivet;

piston means for actuating said firing pin means in response to pressurization of said second cavity;

said body means including a substantially cylindrical main body portion and a manually actuable, tubular handle portion coaxially fitted to said main body portion and selectively axially displaceable with respect thereto, said handle portion operable as a trigger means when moved axially forwardly with respect to said main body portion for selectively actuating said valve means whereby to actuate said piston means and thus said firing pin means to thereby install a rivet;

first spring means for normally biasing said handle portion of said body means to a "fire" position; and, second spring means for normally biasing said piston means to a "fire" position.

2. The tool as defined in claim 1 wherein said fitting means is selectively disengageable from said body means, whereby to permit quick change of said tool for rivets of varying sizes.

3. The combination as defined in claim 1 wherein said firing pin means is associated with said fitting means and axially displaceable internally therewithin.

* * * * *